US010077581B2

(12) United States Patent
Ilardo et al.

(10) Patent No.: US 10,077,581 B2
(45) Date of Patent: Sep. 18, 2018

(54) VEHICLE LATCH ACTIVATION SYSTEM AND MOTOR VEHICLE COMPRISING SUCH VEHICLE LATCH ACTIVATION SYSTEM

(71) Applicant: U-SHIN ITALIA S.P.A, Pianezza (IT)

(72) Inventors: Simone Ilardo, Pianezza (IT); Vittorio Giaccone, Pianezza (IT); Anthony Guerin, Pianezza (IT)

(73) Assignee: U-SHIN ITALIA S.P.A., Pianezza (IT)

( * ) Notice: Subject to any disclaimer, the term of this patent is extended or adjusted under 35 U.S.C. 154(b) by 35 days.

(21) Appl. No.: 15/302,515

(22) PCT Filed: May 4, 2015

(86) PCT No.: PCT/EP2015/059713
§ 371 (c)(1),
(2) Date: Oct. 7, 2016

(87) PCT Pub. No.: WO2015/169744
PCT Pub. Date: Nov. 12, 2015

(65) Prior Publication Data

US 2017/0030116 A1 Feb. 2, 2017

(30) Foreign Application Priority Data

May 5, 2014 (EP) ..... 14425053

(51) Int. Cl.
*E05B 77/06* (2014.01)
*E05B 85/16* (2014.01)

(52) U.S. Cl.
CPC ..... *E05B 77/06* (2013.01); *E05B 85/16* (2013.01)

(58) Field of Classification Search
CPC ..... E05B 85/16; E05B 77/06; Y10T 292/57
See application file for complete search history.

(56) References Cited

U.S. PATENT DOCUMENTS 8,408,612 B2 * 4/2013 Jankowski ..... E05B 77/06 292/216
2009/0243307 A1 * 10/2009 Lee ..... E05B 77/06 292/93

(Continued)

FOREIGN PATENT DOCUMENTS

| | | | |
|---|---|---|---|
| DE | 10114966 | A1 | 10/2002 |
| EP | 2325419 | A2 | 5/2011 |
| WO | 2004/042177 | A1 | 5/2004 |

OTHER PUBLICATIONS

International Search Report issued in corresponding application No. PCT/EP2015/059713 dated Jul. 8, 2015 (3 pages).

(Continued)

*Primary Examiner* — Justin B Rephann
(74) *Attorney, Agent, or Firm* — Burris Law, PLLC

(57) ABSTRACT

The vehicle latch activation system (106) comprises: a bracket (108); an activation element (110) intended to activate a latch (102) by moving with respect to the bracket (108) from an initial position to a final position, wherein a collision (136) on the bracket (108) along a collision direction may cause the activation element (110) to move from its initial position to its final position; and a blocking element (140) intended to move with respect to the bracket (108) as a result of the collision (136), from a disengaged position in which the blocking element (140) allows the activation element (110) to reach its final position, to an intercepting position in which the blocking element (140) is intended to block the activation element (110) at a first intermediate blocked position located between the initial position and the final position of the activation element (110). When moving from its disengaged position to its intercepting position, the blocking element (140) is intended to pass by one or several successive intermediate intercepting positions in which the blocking element (140) is intended to block the activation (Continued)

Figure 1:
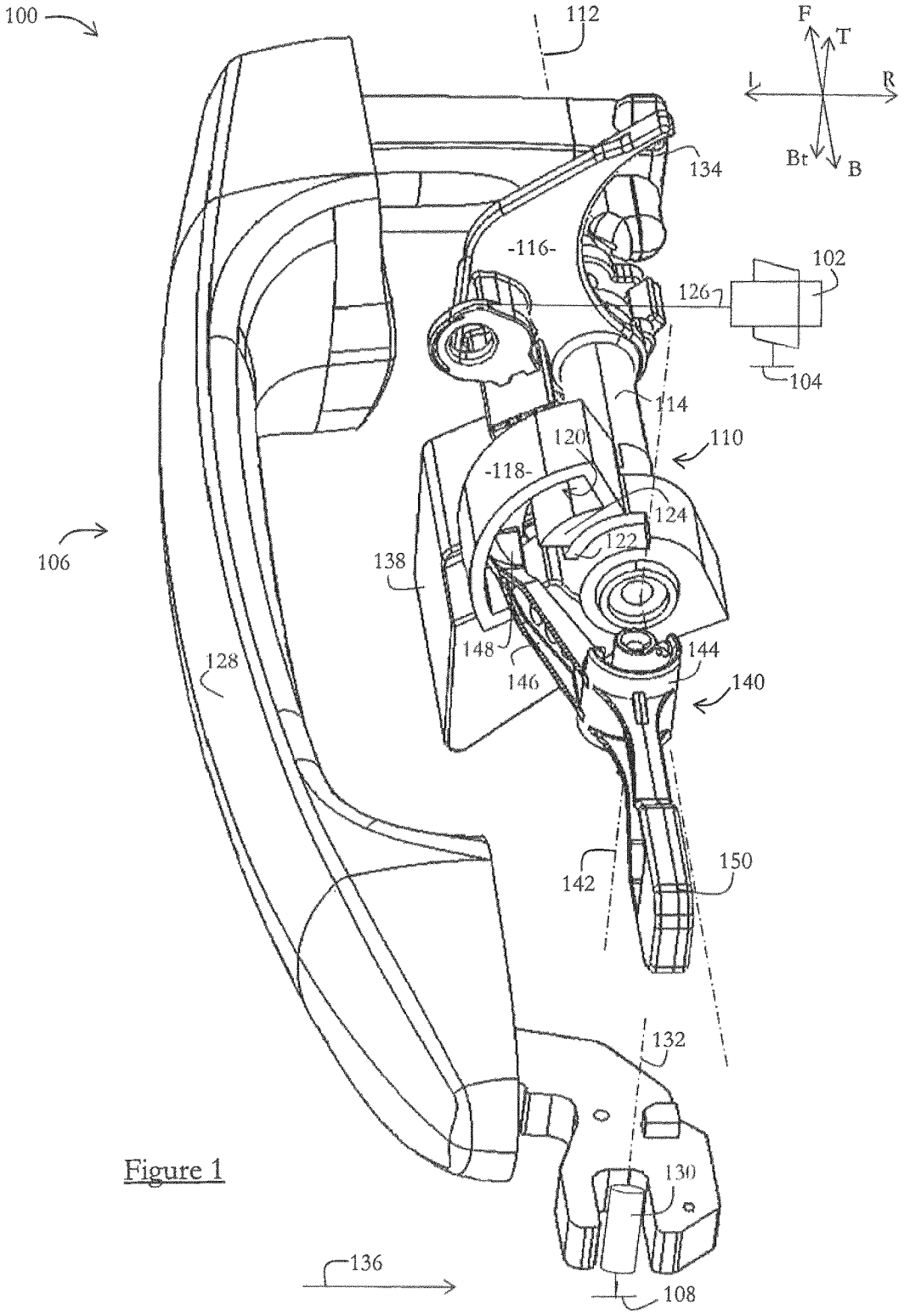

element (110) at respective successive other intermediate blocked positions following each other towards the first intermediate blocked position.

10 Claims, 3 Drawing Sheets

(56) References Cited

U.S. PATENT DOCUMENTS

2010/0207404 A1* 8/2010 Corwin ..... E05B 77/06 292/336.3
2010/0237633 A1* 9/2010 Jankowski ..... E05B 77/06 292/216
2013/0313036 A1* 11/2013 Kovie ..... E05B 77/06 180/274
2014/0167427 A1* 6/2014 Corwin ..... E05B 77/06 292/336.3
2014/0375068 A1* 12/2014 Niegeloh ..... E05B 7/00 292/336.3
2016/0010363 A1* 1/2016 Wahmann ..... E05B 77/04 292/92
2016/0017643 A1* 1/2016 Wahmann ..... E05L 377/54 292/92
2016/0076280 A1* 3/2016 Rudraraju ..... E05B 85/16 292/336.3
2016/0215529 A1* 7/2016 Kovie ..... E05B 77/06
2017/0030117 A1* 2/2017 Savant ..... E05B 77/06
2017/0152683 A1* 6/2017 Nagata ..... E05B 77/06

OTHER PUBLICATIONS

Written Opinion of the International Searching Authority issued in corresponding application No. PCT/EP2015/059713 dated Jul. 8, 2015 (5 pages).

* cited by examiner

VEHICLE LATCH ACTIVATION SYSTEM AND MOTOR VEHICLE COMPRISING SUCH VEHICLE LATCH ACTIVATION SYSTEM

The present invention relates to a vehicle latch activation system and to a motor vehicle comprising such vehicle latch activation system.

Motor vehicle safety standards require that the doors of the vehicle stays closed in case of a collision.

To meet these requirements, the PCT application publication WO 2004/042177 A1 describes a vehicle latch activation system of the type comprising:

a bracket, an activation element intended to activate a latch by moving with respect to the bracket from an initial position to a final position, wherein a collision on the bracket along a collision direction may cause the activation element to move from its initial position to its final position, a blocking element intended to move with respect to the bracket as a result of the collision, from a disengaged position in which the blocking element allows the activation element to reach its final position, to an intercepting position in which the blocking element is intended to block the activation element at a first intermediate blocked position located between the initial position and the final position of the activation element.

The blocking element forms a blocking inertial system.

Generally, the masses of the activation and blocking elements are chosen and distributed to synchronize their relative movement speeds so that the blocking element effectively blocks the activation lever in case of collision. The activation and blocking elements are said to be tuned.

A problem of the previous known system is that the activation element and the blocking element may react differently, in depending for example on the duration of the collision or the strength (acceleration) of the collision. Consequently, if the tuning is optimized for some types of collision, it could not be the case for other types of collision.

There is therefore a need for an inertial system that overcomes at least in part the previous drawback.

Accordingly, it is proposed a vehicle latch activation system of the previous type, characterized in that, when moving from its disengaged position to its intercepting position, the blocking element is intended to pass by one or several successive intermediate intercepting positions in which the blocking element is intended to block the activation element at respective successive other intermediate blocked positions following each other towards the first intermediate blocked position.

Thanks to the invention, the blocking element is able to intercept the activation element at different positions, so that it can intercept the activation element even if it is late or in advance with respect to the activation element.

Optionally, at least one amongst the activation element and the blocking element comprises a pile of stops shifted one with respect to the other in a stairway shape, and the stops are each intended to come into contact with the other amongst the activation element and the blocking element in order to block the activation element at respective ones of the intermediate blocked positions.

Also optionally, going from the top to the base of the pile, the stops respectively correspond to the successive intermediate blocked positions of the activation element, the stop at the base of the pile corresponding to the first intermediate blocked position of the activation element.

Also optionally, the activation element comprises the pile of stops.

Also optionally, the movement of the blocking element from its disengaged position to its intercepting position is essentially perpendicular to courses followed by the stops when the activation element moves from its initial position to its final position.

Also optionally, the pile of stops comprises two stops, a base stop and a top stop, the base stop projecting from the top stop, and, when moving from its disengaged position to its intercepting position, the blocking element is first intended to pass by an intermediate intercepting position in which the blocking element is intended to block the top stop so that the activation element is blocked at a second intermediate blocked position. Furthermore, the blocking element at its intercepting position is intended to block the base stop so that the activation element is blocked at the first intermediate blocked position.

Also optionally, the activation element is intended to rotate around an activation axis.

Also optionally, the blocking element is intended to rotate around a blocking axis.

Also optionally, the blocking axis is essentially orthogonal to the activation axis.

It is also proposed a motor vehicle comprising:

a door, a latch for the door, a vehicle latch activation system according to the invention.

Figure 2:
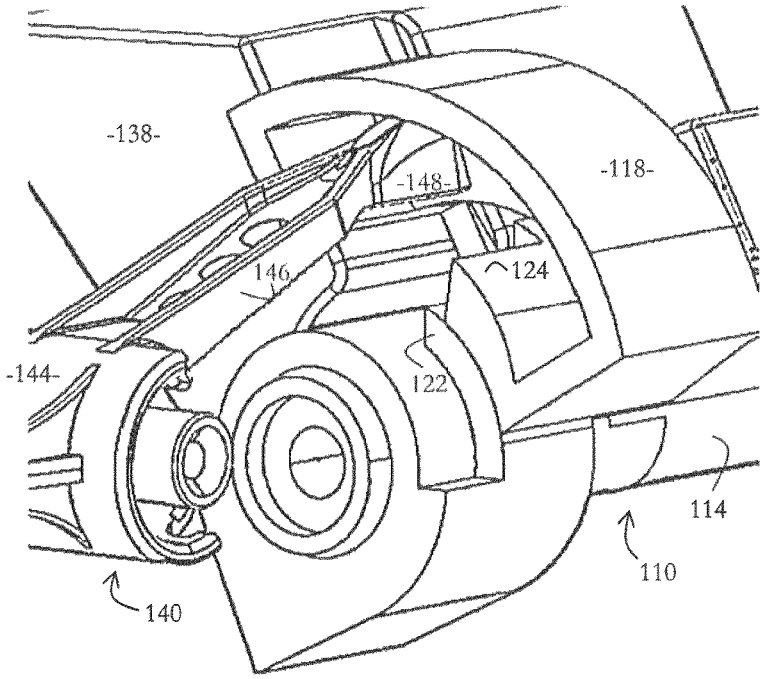
Figure 3:
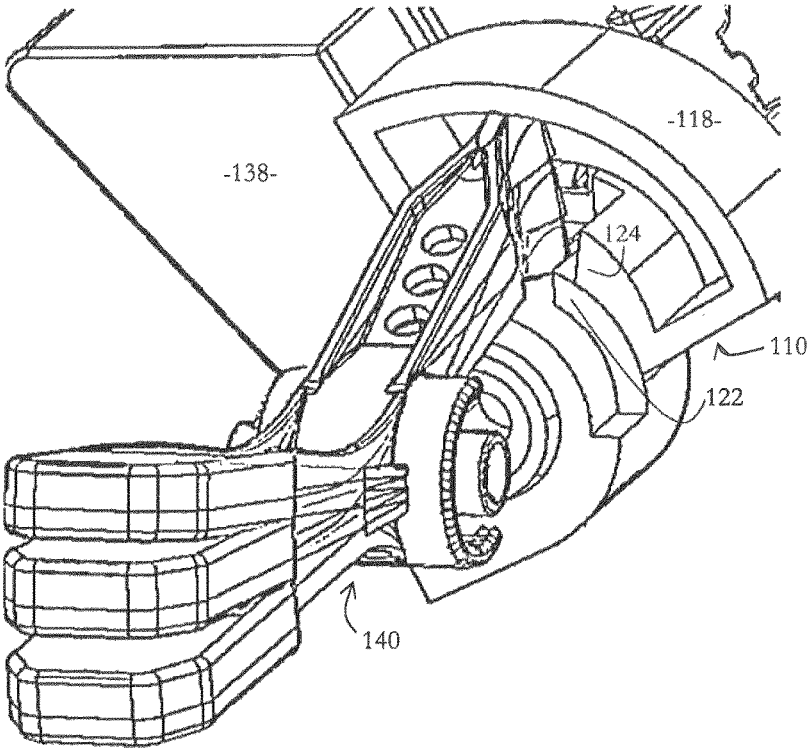
Figure 5:
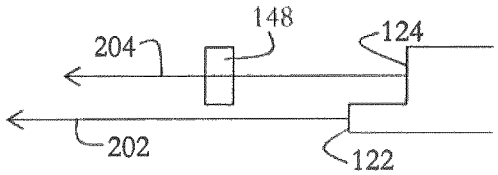
Figure 6:
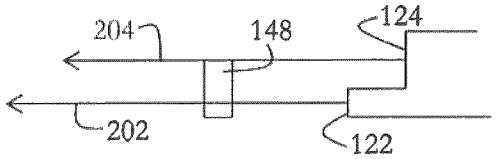
Figure 7:
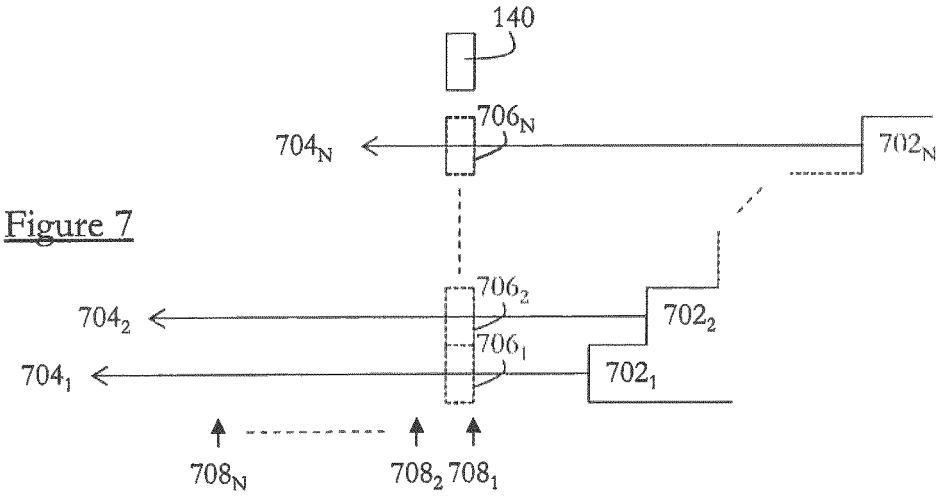

A non-limiting embodiment of the invention will now be described with reference to the accompanying drawings, in which:

FIGS. 1 and 2 are three-dimensional views of a door opening system according to the invention, FIG. 3 is a three-dimensional view of a blocking element of the door opening system of FIGS. 1 and 2, depicted in three superimposed positions, FIGS. 3 to 6 are flattened views of an activation element and a blocking element of the door opening system of FIG. 1 in different configurations, and FIG. 7 is a flattened view of alternate activation and blocking elements.

In the following description, positioning terms such as front, back, left, right, etc., refer to an orthogonal basis comprising the following three directions: front-back F-B, left-right L-R and top-bottom T-B. In the described example, these three directions correspond to the usual directions attached to the motor vehicle. However, in other embodiments of the invention the directions front-back F-B, left-right L-R and top-bottom T-B could be any set of arbitrary directions forming an orthogonal basis.

Furthermore, when the term "essentially" is used in a comparison between directions, it means that there is a tolerance of plus or minus 15° in particular for comparing the previous directions attached to the motor vehicle with movement directions of elements of the door opening system that will be described below. Preferably, the tolerance is plus or minus 10°, in particular for the tolerance between two movement directions of the elements of the door opening system that will be described below. For instance, the expression "two essentially parallel directions" means that the angle between the two directions is equal to zero with a tolerance of plus or minus 15°, that is to say that the angle is in the interval from −15° to 15°.

Referring to FIGS. 1 to 3, a door opening system 100 for a motor vehicle (not depicted) will now be described.

The door opening system 100 first comprises a latch 102 intended, when engaged in a body 104 of the motor vehicle to maintain a door (not depicted) of the motor vehicle closed with respect to the body 104, and, when disengaged from the body 104, to allow opening of the door. In the described example, the door is a left door of the vehicle.

The door opening system 100 further comprises a vehicle latch activation system 106 intended to activate the latch 102 in order to move the latch 102 from its engaged position to its disengaged position.

The vehicle latch activation system 106 first comprises a bracket 108 attached to the door.

The vehicle latch activation system 106 further comprises an activation element 110 intended to move with respect to the bracket 108 from an initial position to a final position in order to activate the latch 102. In the described example, the activation element 110 is intended to rotate around an activation axis 112 extending essentially along the front-back direction F-B of the motor vehicle.

The activation element 110 first comprises a cylindrical body 114 extending around the activation axis 112.

The activation element 110 further comprises a latch activation lever 116 projecting radially in the upward direction from a front end of the cylindrical body 114.

The activation element 110 further comprises a circumferential housing 118 located at a back end of the cylindrical body 114 and delimiting, with the cylindrical body 114, a circumferential recess 120.

The activation element 110 further comprises, in the circumferential recess 120, a pile of stops 122, 124 shifted one with respect to the other in a stairway shape. In the described example, the pile of stops comprises two stops only, a base stop 122 located near the activation axis 112 and a top stop 124 located away from the activation axis 112, the base stop 122 projecting circumferentially from the top stop 124.

The vehicle latch activation system 106 further comprises a Bowden cable 126 connecting the latch activation lever 116 to the latch 102. In this manner, movement of the activation element 110 from its initial position to its final position pulls the Bowden cable 126 which in turn disengages the latch 102.

The vehicle latch activation system 106 further comprises a handle 128 located left from the activation element 110 and intended to be manipulated by a user in order to move the activation element 110 from its initial position to its final position.

In the described example, the handle 128 is what is called a flap handle. The handle 128 comprises a back end engaged in a pin 130 of the bracket 108, so that the handle 128 is able to rotate with respect to the bracket 108 around a handle axis 132 extending essentially along the top-bottom direction T-B of the motor vehicle.

The handle 128 further comprises a front end provided with a hooked arm 134 going round the latch activation lever 116 so as to push the latch activation lever 116 when a user makes the handle 128 rotate around the handle axis 132 towards the left, i.e. away from the motor vehicle.

As it may be appreciated, a collision 136 on the bracket 108 along a left-to-right direction may cause the activation element 110 to move from its initial position to its final position. In fact, the collision 136 pushes the bracket 108 towards the right. As a reaction, because of their inertia, the handle 128 and the activation element 110 tend to move with respect to the bracket towards the left, which tends to make the activation element 110 rotate around the activation axis 112 towards its final position, so that the latch 102 is at risk of being disengaged and the door opened during the collision 136.

In order to prevent opening of the door during the collision 136, the vehicle latch activation system 106 further comprises a counterweight 138 and an inertia mass system for blocking the activation element 110.

The counterweight 138 is intended to counterbalance the movement of the activation element 110 from its initial position to its final position if the collision 136 occurs. In order to achieve this objective, the counterweight 138 is positioned under the activation axis 112, while most of the mass of the activation element 110 is located above the activation axis 112, in particular the latch activation lever 116, the circumferential housing 118 and the stops 122, 124. Furthermore, the activation element 110 is intended to push the counterweight 138 when moving towards its final position.

In the described example, the counterweight 138 is free-wheeling around the activation axis 112. In this manner, in case of a collision on the bracket 108 in the right to left direction, that is to say opposite of the collision 136, the counterweight 138 is uncoupled from the activation element 110, so that the counterweight 138 does not drag along the activation element 110 towards its final position. As an alternative, the counterweight 138 could be attached to the activation element 110.

The inertia mass system comprises a blocking element 140 intended to move with respect to the bracket 108, as a result of the collision 136, from a disengaged position to a blocking position by passing by one or several successive intermediate blocking positions. These positions will be described in greater detail with reference to FIG. 4.

In the described example, the blocking element 140 is intended to rotate with respect to the bracket 108 around a blocking axis 142 extending essentially along the top-bottom direction of the motor vehicle. The blocking element 140 first comprises a sleeve 144 around the blocking axis. The blocking element 140 further comprises a blocking arm 146 projecting from the sleeve essentially in the frontward direction. The blocking arm 146 has a front end 148 located in the circumferential recess 120 of the activation element 110. The blocking element 140 further comprises a mass arm 150 projecting from the sleeve essentially in the backward direction.

Figure 4:
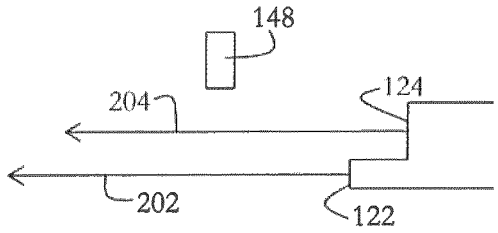

Referring to FIG. 4, the stops 122, 124 follow respective courses 202, 204 when the activation element 110 moves from its initial position to its final position. In the described example, the courses 202, 204 are circular around the activation axis 112.

When in the blocking element 140 is in its disengaged position, the front end 148 of the blocking arm 146 is away from the courses 202, 204 of the stops 122, 124, as illustrated on FIG. 4, so as to allow the activation element 110 to reach its final position.

If the collision 136 occurs, the mass arm 150 moves to the left with respect to the bracket 108, so that the blocking arm 146 moves to the right and comes closer to the activation axis 112. Consequently, the front end 148 of the blocking arm 146 successively crosses the courses 202, 204, in an essentially perpendicular manner.

Referring to FIG. 5, when the front end 148 of the blocking arm 146 crosses the course 204 of the top stop 124, the front end 148 is able to intercept the top stop 124. The blocking element 140 is then in an intermediate intercepting position in which the blocking element 140 is intended to block the activation element 110 at a second intermediate blocked position.

Referring to FIG. 6, when the front end 148 of the blocking arm 146 crosses the course 204 of the base stop 204, the front end 148 is able to intercept the base stop 202. The blocking element 140 is then in an intercepting position in which the blocking element 140 is intended to block the activation element 110 at a first intermediate blocked position. In the first intermediate position, the activation element 110 is closer to the initial position than in the second intermediate blocked position. This means that the latch 102 is more engaged in the first intermediate blocked position than in the second intermediate blocked position of the activation element 110. Preferably, the Bowden cable 126 is pulled by at most 2.5 mm when the activation element moves from its initial position to the first intermediate blocked position. Therefore, blocking the activation element 110 in the first intermediate blocked position is preferable. Consequently, in the best scenario, the front end 148 has the time to reach the course 202 of the base stop 122, so that the activation element 110 is blocked at the first intermediate blocked position.

However, it may happen that the movement of the blocking element 140 is too slow with respect to the movement of the activation element 110, so that it has not the time to reach the course 202 of the base stop 122. It may also happen that the movement of the blocking element 140 is too fast with respect to the movement of the activation element 110, so that the front end 148 rebounds on the cylindrical body 114 and comes back towards its disengaged position before having intercepted the base stop 122. In both cases, the front end 148 has still a chance to intercept the top stop 124 by crossing its course 204, so that the activation element 110 is blocked at the second intermediate blocked position.

Referring to FIG. 7, in a more general alternative, the pile of stops comprises a number N of stops $\mathbf{702}_1 \ldots \mathbf{702}_N$, N being greater than two (the references being ordered from $\mathbf{702}_1$ for the base stop of the pile to $\mathbf{702}_N$ for the top stop of the pile). The stops $\mathbf{702}_1 \ldots \mathbf{702}_N$ are intended to follow respective parallel courses $\mathbf{704}_1 \ldots \mathbf{704}_N$ when the activation element moves from its initial position to its final position.

In that case, the blocking element 140 is first intended to pass by N−1 successive intermediate intercepting positions $\mathbf{706}_N \ldots \mathbf{706}_2$ in which the blocking element 140 is intended to respectively cross the courses $\mathbf{704}_N \ldots \mathbf{704}_2$ starting from the course $\mathbf{704}_N$ of the top stop $\mathbf{702}_N$, in order to block the activation element at respective successive intermediate blocked positions $\mathbf{708}_N \ldots \mathbf{708}_2$.

The blocking element 140 is then intended to reach an intercepting position $\mathbf{706}_1$ in which the blocking element 140 crosses the course $\mathbf{704}_1$ of the base stop $\mathbf{702}_1$ in order to block the activation element at a first intermediate blocked position $\mathbf{708}_1$, that is to say at the blocked position that is the closer to the initial position.

Because of the stairway shape of the pile of stops, the other intermediate blocked positions $\mathbf{708}_N \ldots \mathbf{708}_2$ of the activation element are following each other towards the first intermediate blocked position $\mathbf{708}_1$. This means that the more the blocking element 140 moves towards the intercepting position $\mathbf{706}_1$, the closer to the initial position the activation element is blocked, and therefore the more engaged is the latch 102.

It should be noted that the blocking element 140 may be reversible, which means that it comes back to its disengaged position after the collision 136, for example thanks to a recall spring (not depicted).

However, as an alternative, the blocking element 140 may be irreversible. This may be for example realized by using an anti-run-back system, such as a ratchet (not depicted), preventing the blocking element 140 to move back towards its disengaged position. Preferably, the anti-run-back system is configured to prevent the blocking element 140 to move back when it reaches its intercepting position, and let the blocking element 140 move back to its disengaged position as long as it only reaches an intermediate blocking position.

Furthermore, the vehicle latch activation system 106 could also comprise a damper mechanism intended to slow down the return of the blocking element 140 from its blocking position to its disengaged position. For instance, one of the damper mechanisms described in WO 2012/1755599 A1 could be used.

As it is apparent from the previous description, the invention allows blocking of the activation element for a large range of types of collision, in time and acceleration.

Furthermore, when a freewheeling counterweight 138 is used, it is more reliable in case of a collision in the opposite direction, i.e. for a given door located on a side of the motor vehicle, when the collision strikes on the other side of the motor vehicle.

Furthermore, the same activation and blocking elements may be used for different latch activation systems, for instance with different handles and/or different counterweight.

Furthermore, there is no impact on costs or mass with respect to the known vehicle latch activation system where only one stop is used.

Furthermore, the term "latch" should include any means intended to maintain the vehicle door closed.

In the claims below, the terms used should not be interpreted as limiting the claims to the embodiment described in this description, but should be interpreted so as to include all of the equivalents that the claims are intended to cover in their wording and that can be envisaged by a person skilled in the art applying his or her general knowledge to the implementation of the teaching disclosed above.

In particular, the pile of stops could be carried by the blocking element instead of the activation element.

Furthermore, the previously described mechanism could be applied to any type of handle, for example a grip handle.

The invention claimed is:

1. A vehicle latch activation system comprising:

a bracket;

an activation element that activates a latch by moving with respect to the bracket from an initial position to a final position, wherein a collision on the bracket along a collision direction causes the activation element to move from its initial position to its final position; and a blocking element that moves with respect to the bracket as a result of the collision, from a disengaged position in which the blocking element allows the activation element to reach its final position, to an intercepting position in which the blocking element blocks the activation element at a first intermediate blocked position located between the initial position and the final position of the activation element, wherein, when moving from its disengaged position to its intercepting position, the blocking element passes by one or several successive intermediate intercepting positions, wherein, in each of the intermediate intercepting positions, the blocking element blocks the activation element at a respective intermediate blocked position, and wherein the intermediate blocked positions follow each other successively towards the first intermediate blocked position.

2. The vehicle latch activation system according to claim 1, wherein at least one amongst the activation element and the blocking element comprises a plurality of stops, wherein the stops are formed adjacent to each other in a stair structure, wherein the stair structure comprises a top at one end and a base at the other end, and wherein the stops each come into contact with the other amongst the activation element and the blocking element in order to block the activation element at respective ones of the intermediate blocked positions.

3. The vehicle latch activation system according to claim 2, wherein, going from the top to the base of the stair structure, the stops respectively correspond to the successive intermediate blocked positions of the activation element, the stop at the base of the stair structure corresponding to the first intermediate blocked position of the activation element.

4. The vehicle latch activation system according to claim 2, wherein the activation element comprises the plurality of stops.

5. The vehicle latch activation system according to claim 4, wherein the movement of the blocking element from its disengaged position to its intercepting position is perpendicular to courses followed by the stops when the activation element moves from its initial position to its final position.

6. The vehicle latch activation system according to claim 4, wherein the plurality of stops comprises two stops, a base stop and a top stop, the base stop projecting from the top stop, wherein, when moving from its disengaged position to its intercepting position, the blocking element first passes by an intermediate intercepting position in which the blocking element blocks the top stop so that the activation element is blocked at a second intermediate blocked position, and wherein the blocking element at its intercepting position blocks the base stop so that the activation element is blocked at the first intermediate blocked position.

7. The vehicle latch activation system according to claim 1, wherein the activation element rotates around an activation axis.

8. The vehicle latch activation system according to claim 7, wherein the blocking element rotates around a blocking axis.

9. The vehicle latch activation system according to claim 8, wherein the blocking axis is orthogonal to the activation axis.

10. A motor vehicle comprising:

a door;

a latch for the door; and a vehicle latch activation system according to claim 1 for activating the latch.

* * * * *